US005435069A

United States Patent [19]

Nicholson

[11] Patent Number: 5,435,069

[45] Date of Patent: Jul. 25, 1995

[54] METHOD FOR DETERMINING BOREHOLE DIRECTION

[75] Inventor: James W. Nicholson, Rijswijk, Netherlands

[73] Assignee: Shell Oil Company, Houston, Tex.

[21] Appl. No.: 180,246

[22] Filed: Jan. 12, 1994

[30] Foreign Application Priority Data

Jan. 13, 1993 [EP] European Pat. Off. ..... 93200082

[51] Int. Cl.[6] ..... E21B 47/022

[52] U.S. Cl. ..... 33/304; 33/313; 364/422

[58] Field of Search ..... 364/421, 422, 559; 33/302, 304, 312, 313, 316, 328

[56] References Cited

U.S. PATENT DOCUMENTS

| | | | |
|---|---|---|---|
| 3,791,043 | 2/1974 | Russell | 33/313 |
| 4,163,324 | 8/1979 | Russell et al. | 33/313 |
| 4,682,421 | 7/1987 | van Dongen et al. | 33/302 |
| 4,709,782 | 12/1987 | Walters . | |
| 4,812,977 | 3/1989 | Hulsing, II | 364/422 |
| 5,012,412 | 4/1991 | Helm | 364/422 |
| 5,128,867 | 7/1992 | Helm | 364/422 |

FOREIGN PATENT DOCUMENTS

| | | |
|---|---|---|
| 0387991A2 | 9/1990 | European Pat. Off. . |
| WO92/10642 | 6/1992 | WIPO . |

OTHER PUBLICATIONS

Foreign search report dated 17 Mar. 1994.

*Primary Examiner*—William A. Cuchlinski, Jr.
*Assistant Examiner*—G. Bradley Bennett

[57] ABSTRACT

A method for determining the direction of a borehole during drilling comprises determination of inclination angle $\theta$ and highside angle $\phi$ from gravity acceleration ($\bar{g}$) measurements and determination of azimuth angle $\psi$ from magnetic field ($\bar{B}$) measurements along with the calculated inclination angle $\theta$ and highside angle $\phi$, the determinations being carried out in conventional XYZ-and-NEV coordinate systems coupled by Euler-angle coordinate transformations. In particular $\bar{g}$ and $\bar{B}$ are measured at least at two borehole depths such that $\phi_i$ does not equal $\phi_{i+1}$, and $\psi_i$ and $\psi_{i+1}$ are calculated from $\bar{B}_i=[\phi_i]^T[\theta_i]^T\{[\psi_i]^T\bar{B}_e\}+\bar{B}_p$ with i as number of measurement, $\bar{B}_e$ as local earth magnetic field, and $\bar{B}_p$ as perturbating magnetic field. As a result perturbating magnetic fields, for example caused by hot spots or nearby magnetic steel components in the drilling or logging string nearby the B-measuring device, are determined accurately.

4 Claims, 2 Drawing Sheets

FIG. 2A
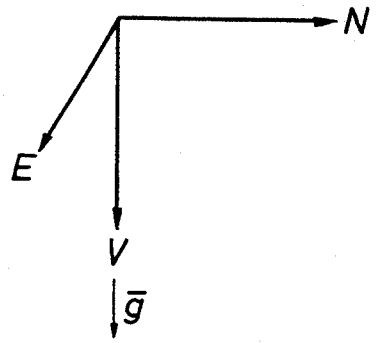
FIG. 2B
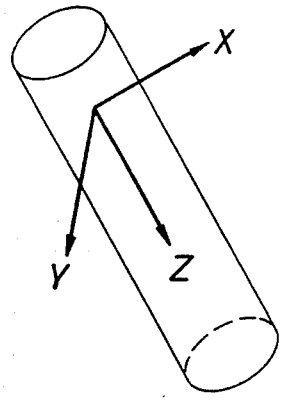
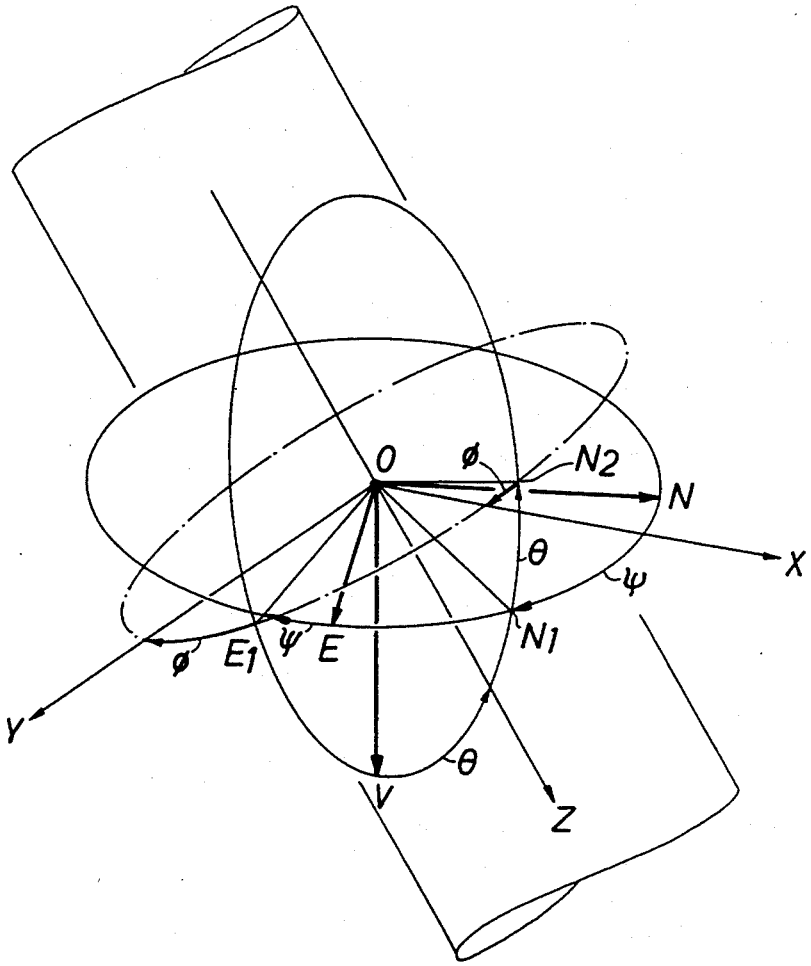
FIG. 3

METHOD FOR DETERMINING BOREHOLE DIRECTION

FIELD OF THE INVENTION

The present invention relates to an improved method for determining the direction of a borehole during drilling said borehole.

In particular the present invention relates to a method for determining the direction of a borehole during drilling said borehole by using a triaxial accelerometer/-magnetometer-package arranged in the drill string employed.

BACKGROUND TO THE INVENTION

U.S. Pat No. 4,163,324 discloses a method to determine the direction of a borehole during drilling using a triaxial accelerometer/magnetometer-package arranged in the drill string, the method including the steps of:

measuring gravity acceleration components $g_x$, $g_y$, $g_z$ of the known local gravity acceleration vector $\bar{g}$ for determining inclination angle $\theta$ and highside angle $\phi$, and measuring magnetic field components $B_x$, $B_y$, $B_z$ of the total magnetic field $\bar{B}$ for determining azimuth angle $\psi$; x, y and z indicating vector components in a Cartesian XYZ-coordinate system fixed to the package during drilling, and $\psi$, $\theta$, and $\phi$ indicating angles defining rotations between said XYZ-system and a Cartesian NEV-coordinate system, with N the magnetic north direction, V the vertical $\bar{g}$-direction, and E the east direction.

Patent '324 discloses a drill string comprising a drilling bit that is coupled at one side by a non-magnetic drill collar and at the other side by a set of drill collars made of magnetic material. The set is further coupled to a drill pipe. The non-magnetic collar contains a survey instrument, for example a triaxial accelerometer/-magnetometer package. When measuring the total magnetic field $\bar{B}$, additional to the earth's magnetic field $\bar{B}_e$ a perturbating magnetic field $\bar{B}_p$ is included, for example from the above said bit and/or set of drill collars. In the method of patent '324 it is assumed that the effect of the magnetic drill string can be approximated by only a $\bar{B}_p$-vector along the borehole axis Z, $\bar{B}_{p,z}$. This assumption enables calculation of an uncorrected azimuth angle, and in a next step to apply an iteration procedure to determine a first order correction. In many conditions, however, the assumption of only a $\bar{B}_{p,z}$ and the approximation of $\bar{B}_{p,z}$ are far from realistic.

For example it is well known that during drilling a non-magnetic collar may become magnetized resulting in so-called hot spots encompassing perturbating magnetic field vectors having unpredictable directions.

In U.S. Pat. No. 4,682,421 a method is presented for determining an azimuth angle that is corrected for drill string magnetization by calculating the perturbating erroneous magnetic field $\bar{M}$ at the location of the instrument. In particular a two-step approach of the above problem is disclosed. After determining the gravity acceleration vector $\bar{g}$ and measuring the total magnetic field $\bar{B}_m$ (equal to $\bar{B}_e+\bar{M}$), in a first step the cross-axial component $\bar{M}_{xy}$ of $\bar{M}$ is determined. At least three x-y-measurements are necessary for the first step because $\bar{M}_{xy}$ is derived graphically from a circle made up of these measurements. The measurements are carried out by rotating the drill string at one location along the borehole axis, being the Z-axis in the measurement coordinate system. It may be clear to those skilled in the art such rotation of the drill string at one location will delay the borehole drilling operation.

The second step of patent '421 involves a geometrical determination of $\bar{M}_z$. However, because the application of the cosine-rule (as shown in FIG. 3 of patent '421) for obtaining a minimum error value has to be restricted mathematically to a plane comprising all the relevant parameters including $\theta$ and 74 $_0$, the determination as presented can only be considered an approximation. Possible errors in $\bar{M}_z$ and $\psi$ are therefore dependent on errors in parameters already used in the cosine-rule.

Thus, it is an object of the present invention to overcome the problem of rotating the drill string each time the direction of the borehole has to be determined. It is a further object of the present invention to present a method enabling determination of azimuth angles which result from straight forward calculation. It is another object of the present invention to arrive at a method resulting in parameter values which are calculated independently thereby avoiding propagating error calculus.

SUMMARY OF THE INVENTION

These and other objects are therefore accomplished by a method for determining the direction of a borehole during drilling of the borehole using a drill string by using a triaxial accelerometer/magnetometer package arranged in the drill string, the method comprising the steps of:

measuring gravity acceleration components $g_x$, $g_y$, $g_z$ of the gravity acceleration vector $\bar{g}$ at a plurality of locations within the borehole where each location within the borehole is $l_i$ where i are consecutive positive integers;

determining inclination angle $\theta$ and highside angle $\phi$ of the borehole at each of locations within the borehole based on the gravity acceleration components;

measuring, at each of the locations within the borehole, magnetic field components $B_x$, $B_y$, $B_z$ of the total magnetic field $\bar{B}$; and determining azimuth angle $\psi$ at each of the locations within the borehole wherein azimuth angles $\psi$ are calculated in accordance with $$\bar{B}_i=[\phi_i]^T[\theta_i]^T\{[\psi_i]^T\bar{B}_e\}+\bar{B}_p$$

where i is a positive integer, $\bar{B}$ is the local earth magnetic field, $\bar{B}_p$ is the magnetic field perturbating $\bar{B}_e$, and $[\,]^T$ indicates "Transpose" matrices for coordinate transformations from the NEV-system to the XYZ-system under Euler-angles $\phi$, $\theta$, and $\psi$, and x, y and z are vector components in a Cartesian XYZ-coordinate system fixed to the package during the drilling, and $\psi$, $\theta$ and $\phi$ are angles defining rotations between said XYZ-system and a Cartesian NEV-coordinate system, with N the magnetic north direction, V the vertical $\bar{g}$-direction, and E the magnetic east or magnetic west direction.

In one embodiment of the present invention, measurements are made at two locations within the borehole, and a relationship selected from the group consisting of $\sin^2\psi_i+\cos^2\psi_i=\sin^2\psi_{i+1}+\cos^2\psi_{i+1}$, $\sin^2\psi_i+\cos^2\psi_i=1$, and $\sin^2\psi_{i+1}+\cos^2\psi_{i+1}=1$ is used in addition to the relationships described above to establish $\psi_i$.

In a further embodiment of the present invention $\bar{g}$ and $\bar{B}$ are measured at least at three borehole lengths $l_i$, $l_{i+1}$, and $l_{i+2}$, such that $\phi_i \neq \phi_{i+1} \neq \phi_{i+2}$, and that $\psi_i$, $\psi_{i+}$, and $\psi_{i+2}$ are calculated in accordance with $\bar{B}_i = [\phi_i]^T[\theta_i]^T\{[\psi_i]^T\bar{B}_e\} + \bar{B}_p$ with i=1, 2, 3, . . .

In a preferred embodiment of the invention as shown above, a step for checking the outcome of azimuth angles obtained is provided in that the $\sin^2\psi = \cos^2\psi = 1$-equation is verified and compared for one or more $\psi$.

Thus, the invention as disclosed above has the advantage that during drilling the borehole measurement values are obtained in a substantially continuous way, both as to the determination of the borehole direction and to checking the measurement values itself. Consequently irregularities in the measuring process, for example due to unexpected formation conditions or apparatus deficiencies, are traced quickly and reliably.

In another embodiment of the present invention the perturbating field $\bar{B}_p$ is determined. Advantageously, $\bar{B}_p$ is obtained from straight forward calculations thus avoiding approximation procedures, such as there are in iterative processes and graphical determination.

BRIEF DESCRIPTION OF THE FIGURES

FIGS. 2A and 2B show respectively an earth reference frame NEV and a tool fixed and package coupled XYZ coordinate frame.

FIG. 3 shows the borehole direction and coordinate frame orientations coupled by Euler angle coordinate transformations.

DETAILED DESCRIPTION OF THE INVENTION

Figure 1:
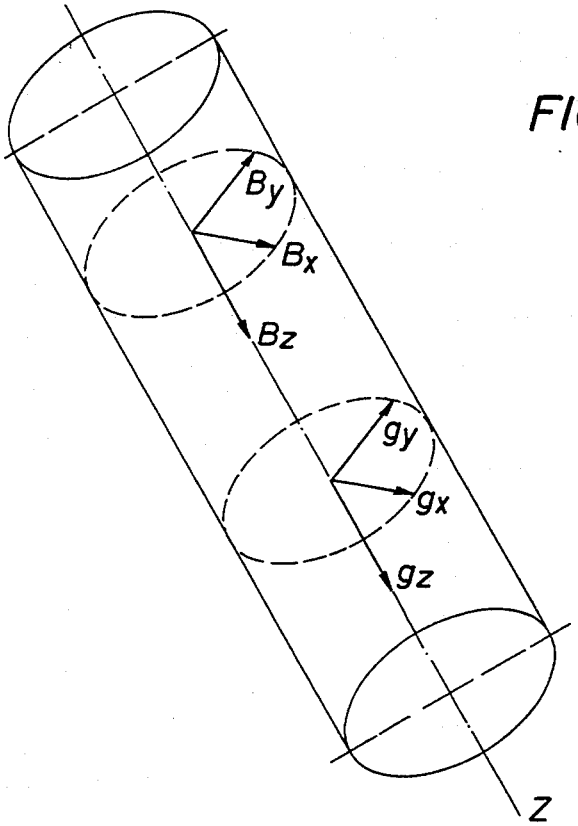
FIG. 1 shows the conventional arrangement of an accelerometer/magnetometer-package within a borehole for measuring $\bar{g}$ and $\bar{B}$ with respect to the same Cartesian coordinate frame.

Referring to FIG. 1 a surveying instrument to be arranged within a borehole is shown schematically. The instrument comprises a well-known accelerometer/-magnetometer-package for measuring gravity vector components $g_x$, $g_y$, $g_z$ and magnetic field vector components $B_x$, $B_y$, $B_z$. The instrument is arranged so that the Z-axis of the instrument is aligned with the borehole Z-axis. Accordingly X- and Y-axes of accelerometer and magnetometer instrument parts are mutually aligned as shown in FIG. 1.

In FIGS. 2A and 2B coordinate-frames as used are shown schematically. In FIG. 2A the earth reference frame NEV is shown; N the local magnetic north direction, V the direction of the local gravity vector, and E the east direction, perpendicular to the plane defined by N and V. In FIG. 2B a Cartesian XYZ-axis is shown with the Z-axis being aligned with the borehole axis.

In FIG. 3 both NEV and XYZ frames are shown with respect to a borehole schematically presented and with respect to each other. As shown in FIG. 3, a sequence of three rotations couples vectors in each of the frames, i.e. an azimuth angle $\psi$, an inclination angle $\theta$ and a high-side angle $\phi$. These angles are typically referred to as Euler-angles. The rotations are conventional coordinate transformations represented by matrices, giving for a vector $P_{XYZ}$ and $P_{NEV}$ a formula $P_{NEV} = [\psi][\theta][\phi]P_{XYZ}$, or equivalently
$P_{XYZ} = [\phi]^T[\theta]^T[\psi]^T P_{NEV}$, with $$[\psi] = \begin{bmatrix} \cos\psi & -\sin\psi & 0 \\ \sin\psi & \cos\psi & 0 \\ 0 & & 1 \end{bmatrix}, \quad (1)$$

$$[\theta] = \begin{bmatrix} \cos\theta & 0 & \sin\theta \\ 0 & 1 & 0 \\ -\sin\theta & 0 & \cos\theta \end{bmatrix}, \text{ and} \quad (2)$$

$$[\phi] = \begin{bmatrix} \cos\phi & -\sin\phi & 0 \\ \sin\phi & \cos\phi & 0 \\ 0 & & 1 \end{bmatrix}, \text{ whereas} \quad (3)$$

$[\psi]^T$, $[\theta]^T$, *and* $[\phi]^T$ are the corresponding so-called "Transpose" matrices. As stated above for any $P_{XYZ}$-$P_{NEV}$-vector couple, the same can be applied on the gravity vector $\bar{g}$, being (0,0,g), and $\bar{B}$, being $(B_N, 0, B_V)$, both in the NEV-frame.

$$\begin{bmatrix} g_x \\ g_y \\ g_z \end{bmatrix} = [\phi]^T[\theta]^T[\psi]^T \begin{bmatrix} 0 \\ 0 \\ g \end{bmatrix}, \text{ and} \quad (4)$$

$$\begin{bmatrix} B_x \\ B_y \\ B_z \end{bmatrix} = [\phi]^T[\theta]^T[\psi]^T \begin{bmatrix} B_N \\ 0 \\ B_V \end{bmatrix}. \quad (5)$$

For the specific example of the gravity vector it is noted that the inclination angle $\theta$ and the high-side angle $\phi$ can be determined easily for every measurement location as disclosed in, for example, U.S. Pat. No. 4,163,324.

Figure 4:
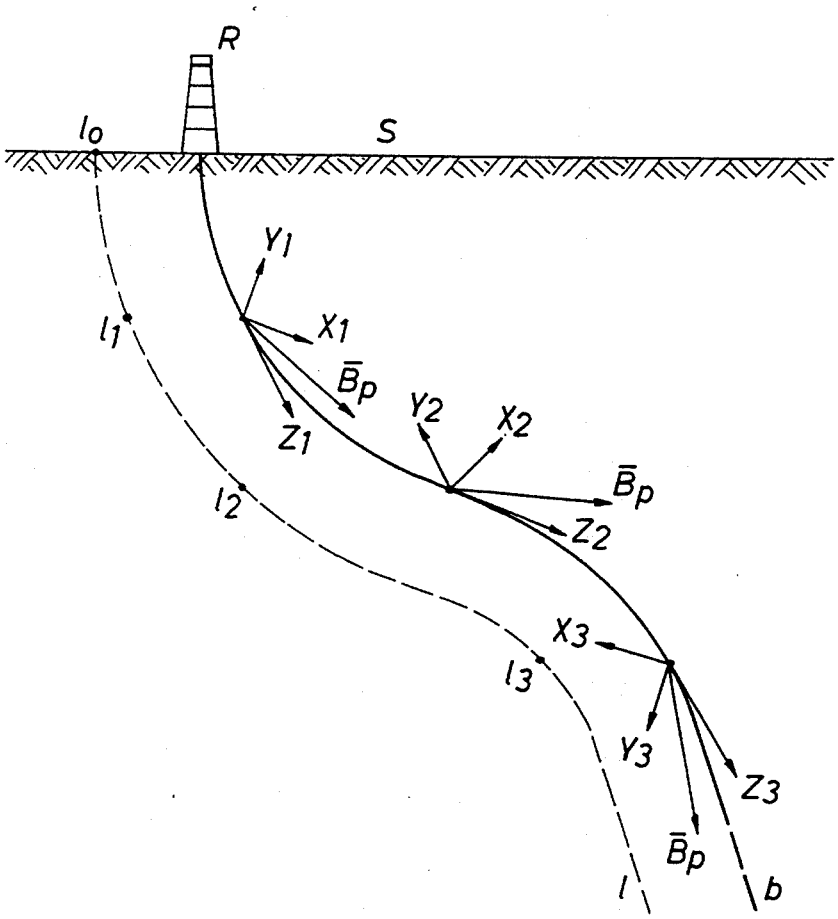
FIG. 4 shows schematically the method of measuring during drilling in accordance with the present invention.

FIG. 4 shows schematically the method for determining the direction of a borehole during drilling said borehole. From a rig R at the earth's surface S a borehole b is drilled. For reason of clarity a parallel curve 1 is drawn (as dashed line) for indicating borehole depths (or borehole lengths, or borehole locations) $l_0$, $l_1$, . . . , which are measured along the borehole, with $l_0$ at S, at which locations $\bar{g}$- and $\bar{B}$-measurements are carried out. Schematically, $x_i$, $y_i$, $z_i$, are shown, demonstrating the variable positioning of the survey instrument in the borehole. A perturbating magnetic field $\bar{B}_p$ is shown. This $\bar{B}_p$ is considered dependent on drill string features as explained before, resulting in turn in a rotation and translation of the vector according to the rotation and translation of the XYZ-frame with the survey instrument in the drill string.

From the above it may be clear that at every borehole depth or location $l_i$ the total magnetic field $\bar{B}_i$ can be written as $\bar{B}_i = \bar{B}_e + \bar{B}_p$. However, to calculate this vector sum, a common base or common coordinate frame has to be chosen. As explained above conventionally the XYZ-frame and NEV frame are employed.

In order to arrive at the direction of the borehole, besides $\theta_i$, and $\phi_i$ angles, azimuth angles $\psi_i$ have to be determined. Thereto the above-mentioned vector sum can be expressed as $$\begin{bmatrix} B_x \\ B_y \\ B_z \end{bmatrix}_i = [\phi]_i^T[\theta]_i^T \left\{ [\psi]_i^T \begin{bmatrix} B_N \\ 0 \\ B_V \end{bmatrix} \right\} + \begin{bmatrix} B_{px} \\ B_{py} \\ B_{pz} \end{bmatrix} \quad (6)$$

for any borehole depth $l_i$ or measurement number i. From this equation it can be seen easily, that $B_x$, $B_y$ and $B_z$ are known because they are measured, that the $\phi$- and $\theta$-matrices are known because $\phi$ and $\theta$ are determined as described above, that $B_N$ and $B_V$ are known from geomagnetic data bases, and that azimuth angle $\psi$ and magnetic field perturbation vector components $B_{px}$, $B_{py}$, $B_{pz}$ have yet to be obtained.

In accordance with the present invention, the components of $\bar{g}$ and $\bar{B}$ are measured for at least two borehole depths $l_i$ and $l_{i+1}$, which can be written as $l_1$ and $l_2$. The following equations are obtained by rewriting the above equation (6):

$$\begin{bmatrix} B_{x1} \\ B_{y1} \\ B_{z1} \end{bmatrix} = [\phi_1]^T[\theta_1]^T \left\{ \begin{matrix} B_N \cos \psi_1 \\ -B_N \sin \psi_1 \\ B_V \end{matrix} \right\} + \begin{bmatrix} B_{px} \\ B_{py} \\ B_{pz} \end{bmatrix}, \text{ and} \quad (7)$$

$$\begin{bmatrix} B_{x2} \\ B_{y2} \\ B_{z2} \end{bmatrix} = [\phi_2]^T[\theta_2]^T \left\{ \begin{matrix} B_N \cos \psi_2 \\ -B_N \sin \psi_2 \\ B_V \end{matrix} \right\} + \begin{bmatrix} B_{px} \\ B_{py} \\ B_{pz} \end{bmatrix}. \quad (8)$$

By well known straight forward calculation of the above equations (7) and (8) it can be seen that the resulting 6 scalar equations for each of the vector components x, y and z, can be considered to comprise 7 unknown parameters, i.e. $\cos\psi_1$, $\sin\psi_1$, $\cos\psi_2$, $\sin\psi_2$, $B_{px}$, $B_{py}$ and $B_{pz}$.

In order to arrive uniquely at $\psi_1$ and $\psi_2$, a seventh scalar equation, $\sin^2\psi_1+\cos^2\psi_1=\sin^2\psi_2+\cos^2\psi_2$, is taken. It may be clear to those skilled in the art that the equivalent equations, $\sin^2\psi_1+\cos^2\psi_1=1$, or $\sin^2\psi_2+\cos^2\psi_2=1$, could alternatively be used. It is evident from the above equations that $\phi_1$ can not equal $\phi_2$, and thus the drill string should be rotated between measurements. This criterion is substantially always satisfied because the drill string is generally rotated between survey location during drilling of the borehole. Thus, advantageously the rotations of the drill string usually occurring during the drilling operation are used, rather than stopping the drilling operation and subsequently rotating as referred to above. After having calculated the values for the 7 parameters $\psi_i$-values are obtained in accordance with, for example:

$$\psi_i = \arctan\left(\frac{\sin\psi_i}{\cos\psi_i}\right). \quad (9)$$

Based on the same idea, for three measurements at correspondingly three measurement locations, for example $l_1$, $l_2$ and $l_3$, the following equations can be obtained. Two of which equations are identical to the above (7) and (8):

$$\begin{bmatrix} B_{x1} \\ B_{y1} \\ B_{z1} \end{bmatrix} = [\phi_1]^T[\theta_1]^T \left\{ \begin{matrix} B_N \cos \psi_1 \\ -B_N \sin \psi_1 \\ B_V \end{matrix} \right\} + \begin{bmatrix} B_{px} \\ B_{py} \\ B_{pz} \end{bmatrix}, \quad (7)$$

$$\begin{bmatrix} B_{x2} \\ B_{y2} \\ B_{z2} \end{bmatrix} = [\phi_2]^T[\theta_2]^T \left\{ \begin{matrix} B_N \cos \psi_2 \\ -B_N \sin \psi_2 \\ B_V \end{matrix} \right\} + \begin{bmatrix} B_{px} \\ B_{py} \\ B_{pz} \end{bmatrix}, \text{ and} \quad (8)$$

$$\begin{bmatrix} B_{x3} \\ B_{y3} \\ B_{z3} \end{bmatrix} = [\phi_3]^T[\theta_3]^T \left\{ \begin{matrix} B_N \cos \psi_3 \\ -B_N \sin \psi_3 \\ B_V \end{matrix} \right\} + \begin{bmatrix} B_{px} \\ B_{py} \\ B_{pz} \end{bmatrix}. \quad (10)$$

From the 9 scalar equations which are found by reformulating the above equations (7), (8) and (10), it can be to seen in the same way as shown above that for the 9 unknown parameters the system of equations is complete and no further equations are necessary for solving them uniquely. For the present system of equations $\cos\psi_1$, $\sin\psi_1$, $\cos\psi_2$, $\sin\psi_2$, $\cos\psi_3$, $\sin\psi_3$, $B_{px}$, $B_{py}$ and $B_{pz}$ again can be considered as independent variables. Again $\psi_i$-values are obtained in accordance with the above equation (9).

Analogously to the case of only two measurements it is noted that $\phi_1$, $\phi_2$, and $\phi_3$ must each be different than each other, and no further specific rotation of the drill string is necessary.

In a further embodiment of the present invention a check-procedure is comprised.

In case of having carried out measurements at two locations $l_1$ and $l_2$, one of the equivalents $\sin^2\psi_1+\cos^2\psi_1=\sin^2\psi_2+\cos^2\psi_2$, being $\sin^2\psi_1+\cos^2\psi_1=1$ or $\sin^2\psi_2+\cos^2\psi_2=1$, are employed for check purposes. If significant deviations from 1 appear, at a next borehole depth a new set of $\bar{B}$ and $\bar{g}$ measurements is taken and the check-procedure can be repeated. Advantageously, also for such a check no additional rotations are required. Again only different highside angles have to be measured.

As to the case having carried out measurements at three locations and consequently using nine equations for determining azimuth angles $\psi_1$, $\psi_2$ and $\psi_3$, now $\sin^2\psi_i+\cos^2\psi_i=1$-equalities, or one of its equivalents being $\sin^2\psi_i+\cos^2\psi_i=\sin^2\psi_{i+1}+\cos^2\psi_{i+1}$ for respective i-value, are applied for the first time. The same observations are made as to the use and application of said check-procedure.

In a next step $\bar{B}_p$ can be determined accurately and reliably. In most cases $\bar{B}_p$ is coupled to drill string characteristics. Besides such $\bar{B}_p$-determinations sudden changes in $\bar{B}_p$ can be traced, for example caused by tool failure, magnetic storms, extraneous magnetic fields, etc.

As explained above, for the one or the other determination procedure, only two or three measurement sets respectively are required. It may be clear that normal operation conditions cover several thousands of feet or several kilometers borehole depths and a plurality of measurement sets are obtained. Consequently borehole directions can be determined and followed quickly and reliably without special operational effort.

Various modifications of the present invention will become apparent to those skilled in the art from the foregoing description. Such modifications are intended to fall within the scope of the present invention and reference is made to the appended claims to determine the full scope of the present invention.

I claim:

1. A method for determining the direction of a borehole during drilling of the borehole using a drill string by using a triaxial accelerometer/magnetometer package arranged in the drill string, the method comprising the steps of:

measuring, during drilling gravity acceleration components $g_x$, $g_y$, $g_z$ of the gravity acceleration vector $\bar{g}$ at a plurality of locations within the borehole where each location within the borehole is $l_i$ where i are consecutive positive integers;

determining inclination angle $\theta$ and highside angle $\phi$ of the borehole at each of locations within the borehole based on the gravity acceleration components;

measuring, during drilling at each of the locations within the borehole, magnetic field components $B_x$, $B_y$, $B_z$ of the total magnetic field $\bar{B}$; and determining azimuth angle $\psi$ at each of the locations within the borehole wherein azimuth angles $\psi$ are calculated in accordance with $$\bar{B}_i=[\phi_i]^T[\theta_i]^T\{[\psi_i]^T\bar{B}_e\}+\bar{B}_p$$

where i=is a positive integer each corresponding to a measurement location, $\bar{B}_e$ is the local earth magnetic field, $\bar{B}_p$ is the magnetic field perturbating $\bar{B}_e$, and $[\ ]^T$ indicates "Transpose" matrices for coordinate transformations from the NEV-system to the XYZ-system under Euler-angles $\phi$, $\theta$, and $\psi$, and x, y and z are vector components in a Cartesian XYZ-coordinate system fixed to the package during the drilling, and $\psi$, $\theta$ and $\phi$ are angles defining rotations between said XYZ-system and a Cartesian NEV-coordinate system, with N the magnetic north direction, V the vertical $\bar{g}$-direction, and E the magnetic east or magnetic west direction.

2. The method of claim 1 wherein the plurality of locations are two locations and a unique set of magnetic field perturbation vector components are obtained using an additional relationship selected from the group consisting of $\sin^2\psi_i+\cos^2\psi_i=\sin^2\psi_{i+1}+\cos^2\psi_{i+1}$, $\sin^2\psi_i+\cos^2\psi_i=1$, and $\sin^2\psi_{i+1}+\cos^2\psi_{i+1}=1$.

3. The method of claim 1, further comprising the steps of:

checking if $(\sin^2\psi_i+\cos^2\psi_i)$ and $(\sin^2\psi_{i+1}+\cos^2\psi_{i+1})$ are equal to about 1;

measuring $\bar{g}$ and $\bar{B}$ at least at one further borehole depth $l_{i+2}$ if $(\sin^2\psi_i+\cos^2\psi_i)$ and $(\sin^2\psi_{i+1}+\cos^2\psi_{i+1})$ are not equal to about 1, with $\phi_i$, $\phi_{i+1}$, and $\phi_{i+2}$ not being equal to each other; and calculating $\psi_{i+2}$ based on the measured $\bar{g}$ and $\bar{B}$.

4. The method of claim 1 wherein the perturbating magnetic field $\bar{B}_p$ is determined.

* * * * *